United States Patent [19]

O'Keeffe et al.

[11] Patent Number: 4,539,783

[45] Date of Patent: Sep. 10, 1985

[54] BARRELL VAULT SKYLIGHT SYSTEM

[75] Inventors: William F. O'Keeffe; Sonny Q. Garcia, both of San Francisco, Calif.

[73] Assignee: O'Keeffe's, Inc., San Francisco, Calif.

[21] Appl. No.: 530,950

[22] Filed: Sep. 12, 1983

[51] Int. Cl.[3] ..... E04B 7/18

[52] U.S. Cl. ..... 52/200

[58] Field of Search ..... 52/200, 72, 235, 308, 52/788

[56] References Cited

U.S. PATENT DOCUMENTS

| | | | |
|---|---|---|---|
| 3,762,120 | 10/1973 | Janssen | 52/200 |
| 3,844,087 | 10/1974 | Schultz et al. | 52/200 |
| 4,251,964 | 2/1981 | Francis | 52/235 |

FOREIGN PATENT DOCUMENTS

| | | |
|---|---|---|
| 0023969 | 2/1981 | European Pat. Off. . |
| 0038398 | 10/1981 | European Pat. Off. . |
| 2036158 | 12/1970 | France . |
| 2314340 | 7/1977 | France . |

*Primary Examiner*—James L. Ridgill, Jr.

*Attorney, Agent, or Firm*—Fliesler, Dubb, Meyer & Lovejoy

[57] ABSTRACT

A skylight system 10 is provided which has sills 22 which can be secured to the appropriate structure 20 and sill caps 74, 76 which can be snapped into engagement with the sills 22. The support rafters 60, 62 can be snapped into engagement with the sills to support panels 12, 14, 16 which are disposed thereupon. A strap 140 with a cooperating mechanism 141 is disposed above the panels 12, 14, 16 and can be urged into selective engagement with the sill cap 74, 76 so as to hold the panels 12, 14, 16 in place upon the support rafters 60, 62.

31 Claims, 3 Drawing Figures

BARRELL VAULT SKYLIGHT SYSTEM

DESCRIPTION

1. Field of the Invention

The present invention is directed toward skylight systems and in particular to skylight systems with repeating elements which can be assembled according to the required skylight size.

2. Background Art

There are a number of skylights which are presently commercially available. The smaller skylights are generally constructed with a single, generally transparent, panel or bubble member which is supported on a rectangular frame. Generally, the larger skylights, which are capable of being constructed to cover practically any size openings, are comprised of a number of repeating panels, which are joined together to form the skylight and which are supported by rafters and cross-members. In these skylights there is a clamping mechanism in combination with a sealing mechanism for joining and sealing the adjacent panels so that the skylight once constructed is waterproof. The clamping and ceiling mechanism also ensure that the panels are properly joined to the rafters and cross-members.

One skylight which can be substantially classified as presented above is found in U.S. Pat. No. 3,762,120, issued to Janssen on Oct. 2, 1973. This patent discloses both a single and a double glazed skylight, both of which are comprised of a plurality of panels, the panels being positioned and held in place by aluminum extrusions cut to the appropriate sizes. These extrusions are provided with threaded bores which are necessary for purposes of securing the panels and extrusions together with appropriate bolts. A close review of this skylight will reveal that extrusions of varying sizes are required to build skylights of varying sizes. The reason for this is that as the skylight becomes larger, the various rafters and cross-members are required to have a larger cross section so that these rafters and cross-members can support the weight of the skylight. Thus, the various extrusions, which retaining their basic shape, would have to be enlarged in order to accommodate enlarged rafters and cross-members. Quite naturally there is a distinct disadvantage in having to stock or manufacture extrusions of varying sizes in order to have the capability of constructing a skylight of the required size.

Further with respect to the above skylight in U.S. Pat. No. 3,762,128, different size extrusions are required for single and multiple glazing. This again is a distinct disadvantage in such skylights as various sizes and configurations of extrusions must be made and stocked in order to accommodate single and multiple glazing requirements.

Still further with respect to the construction of the above skylight, the rafters and cross-members and other framing members for the panels are designed so that there is an unnecessary amount of metal structure located above the panels with the primary purpose of holding the panels in position with the respect to the rest of the skylight. None of this structure is particularly useful in supporting the weight of the skylight.

The present invention is directed to overcoming one or more of the disadvantages as set out above.

SUMMARY OF THE INVENTION

In one aspect of the invention a skylight comprises a sill adapted to be fastened to a structure with at least one support rafter and means for interconnecting the support rafter and the sill. The skylight further comprises a first sill cap and means for interconnecting the first sill cap with the sill. The structure further includes a second sill cap and means for interconnecting the second sill cap with the sill, the second sill cap being nested about the first sill cap. The skylight further includes a first gasket and a means for mounting the first gasket to the support rafter. A first panel is also included in the skylight. The first sill cap has a first sill flange means for positioning the first panel between the first sill cap flange means and the first gasket mounted on the support rafter. The skylight further comprises a second gasket, a means for mounting the second gasket to said first panel, in line with the first gasket. A second panel is also provided for the skylight. The second sill cap has a second sill cap flange means for positioning the second panel between the second sill cap flange means and the second panel mounted on the second gasket. The skylight further comprises a strap means for holding the first and second panels in place, the strap means is positioned over the second panel and the strap means includes means for cooperating with the flange means of the second sill cap to selectively tighten said strap means.

In another aspect of the invention, the skylight comprises a sill adapted to be fastened to a structure, at least one supporting rafter and means for interconnecting the supporting rafter with the sill. The skylight further includes a sill cap and means for interconnecting the sill cap with the sill. The skylight is also provided with a gasket and means for mounting the gasket to the support rafter. A panel is further provided. The sill cap has a sill cap flange means for allowing the panel to be positioned between the flange means and the gasket mounted on the support rafter. A strap means is provided for holding the panel in place. The strap means is positioned over the panel. The strap means includes means for cooperating with the sill cap flange means to selectively tighten the strap means.

The present invention has several advantages over the prior art. The first of these advantages is the fact that as the size of the skylight increases and the requirement for additional support is included in the design of the skylight, only the cross section of the support rafters needs to be increased in order to accommodate the increased weight. Existing extrusions such as the sill and sill caps and the various gaskets remain the same size as these extrusions and gaskets can accommodate various sizes of support rafters. The present invention is easily assembled without the requirement for providing extrusions with threaded bores. In fact the present invention can be snapped together in a period of time which is quite reduced compared to that required for constructing existing skylights.

Further the present invention allows for the same extrusions to be used without modification for both single and double glazed skylights. Also the skylight is designed so that the structural strength required to support the skylight is positioned in the support rafters. There is only a light strap means positioned above the panels which is used to hold the panels in place over the support rafters. Thus there is no excessive metal member placed on top of the panels, as shown by the prior art, and which must also be supported, for merely holding the panels in place.

Further it should be noted that the strap means includes means for interconnecting the straps with the flange means of the sill cap which enables the strap means to be selectively tightened as the skylight and the strap means are snapped together.

Further the invention includes the gaskets which have alignment means for allowing the gaskets to be quickly and properly aligned with each other and with the strap means and support rafter so that the skylight can be quickly assembled.

Other advantages and objects of the invention can be obtained from a review of the specification, the claims and the figures.

DETAILED DESCRIPTION OF THE PREFERRED EMBODIMENT

Figure 1:
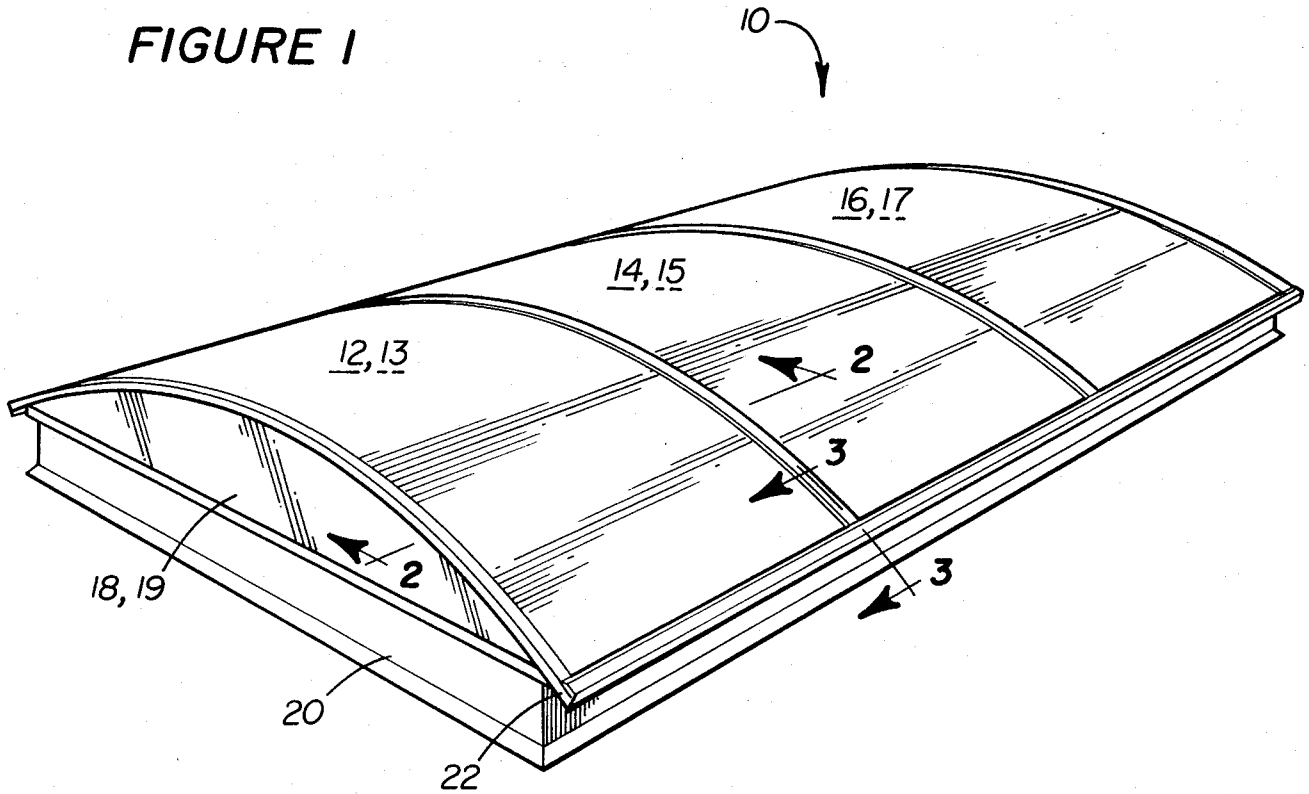
FIG. 1 is a respective view of a preferred embodiment of the skylight system of the invention.

With reference to the Figures and in particular to FIG. 1 the skylight system 10 of the invention which can be used to construct a barrel vault skylight is depicted. As depicted in FIG. 1, skylight system 10 is a double glazed system and includes three side-by-side sets of transparent panels 12, 13 and 14, 15 and 16, 17 which are supported by the remainder of the skylight system 10 and end panels sets such as panels 18, 19. In a preferred embodiment, these panels can be comprised of a plastic or acrylic material. However, it should be understood that other materials can be used to construct the panels and come within the scope and spirit of the invention. The skylight system is mounted on a structure 20, which in FIG. 1 is shown as a substantially rectangular base and which is shown in cross-section FIGS. 2 and 3. The structure 20 is generally built into the roof of the building which is to receive the skylight system 10 so that the skylight system 10 can be mounted thereto.

Skylight system 10 includes a sill 22 (FIG. 3) which in a preferred embodiment is comprised of an aluminum extrusion. Sill 22 is comprised of a first member 24 which is adapted to be mounted on the upper surface of the structure 20. Member 24 can be fastened to the upper surface of the structure 20 by appropriate means such as bolt 26 depicted in FIG. 3. Extending from member 26 and projecting outwardly and downwardly from the structure 20 so as to form an obtuse angle with member 26 is an intermediate portion 28 of sill 22. Sill 22 further includes another member 30 which is upstanding from intermediate member 28 and is disposed in a preferred embodiment at an angle of approximately 90° from intermediate member 28. Attached to another member 30 and projecting substantially at right angles thereto in the direction of structure 20 is a flange 32. Projecting on the other side of another member 30 and in a direction opposite to flange 32 are first and second channels 34 and 36. Channels 34 and 36 are substantially comprised of parallel flanges 38, 40 and 42. Flanges 38 and 40 include bulbous ends 44 and 46 which are used to retain other extrusions (described hereinbelow) in said channels. At the end of another member 30 located distally from intermediate member 28 is a third channel 48. Third channel 48 is essentially comprised of L-shaped flanges 50 and 52, the lower portions of which are directed toward each other to form a neck with a reduced cross-section. Received in third channel 48 is a gasket 54, which in a preferred embodiment is comprised of an elastomeric extrusion and in particular is comprised of extruded neoprene. Gasket 54 includes a pointed projection 56 which has a neck portion. The point of projection is urged into the space between the lower portions of the L-shaped flanges until the neck portion of the gasket is positioned in the neck portion of the channel 48. So arranged, the gasket 54 is held in position in the third channel 48. The upper surface of the gasket 54 includes a plurality of channels 58 which are used to provide a seal with a panel resting thereon as will be described more fully hereinbelow.

Figure 2:
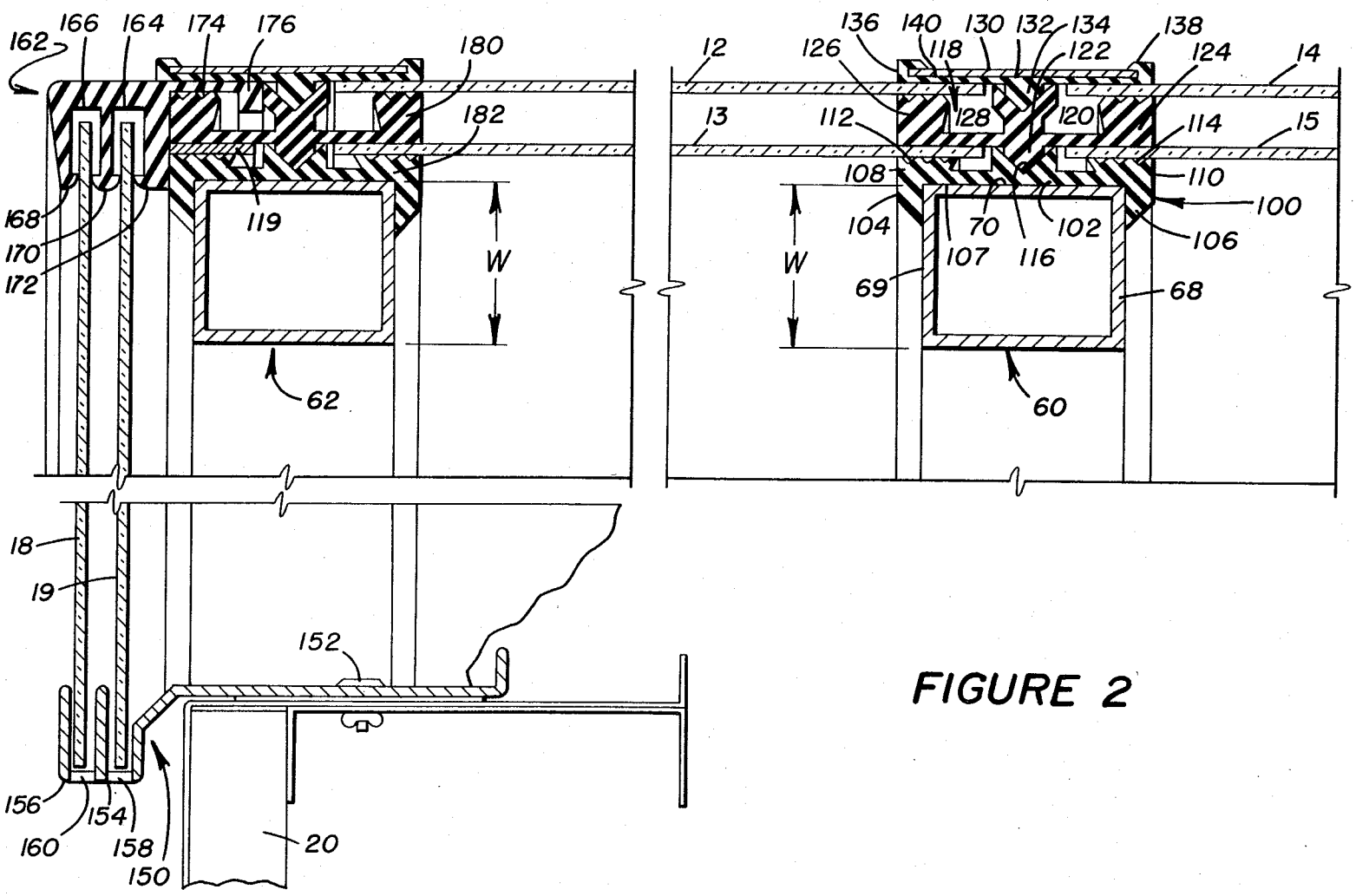
FIG. 2 is a cross-sectional view taken through Line 2—2 in FIG. 1.
Figure 3:
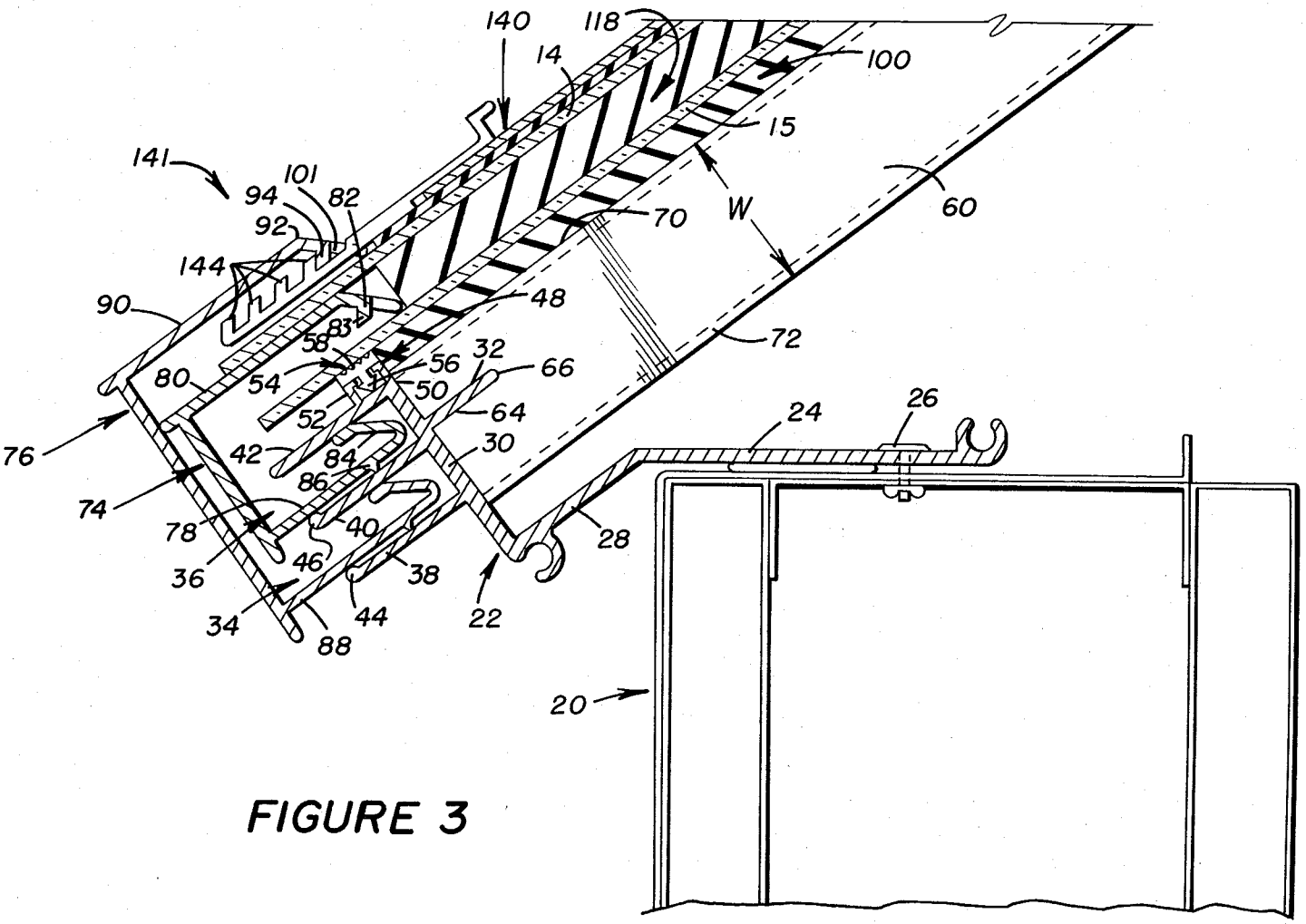
FIG. 3 is a cross-sectional view taken through Line 3—3 in FIG. 1.

The skylight system 10 further includes support rafters, such as support rafters 60 in FIGS. 2 and 3 and 62 in FIG. 2. Support rafters 60 and 62 in a preferred embodiment are essentially tubular aluminum extrusions. It is to be understood that other forms of extruded and nonextruded support rafters can be utilized and still be within the scope and spirit of the invention.

As can be seen in FIG. 3, the support rafters, and in particular support rafter 60, include a groove 64 which receives the flange 32 which projects from sill 22. Flange 32 is thus used to mount the support rafter 60 to the sill 22 without the use of bolts or other fasteners. In order to lock the support rafter 60 in a position on the sill 22 so that the support rafter cannot slide with respect thereto, flange 32 is provided with grooves, such as groove 66, which receive the walls of the support rafter such as walls 68, 69 in FIG. 2.

It should be understood that one of the great versatilities of the present invention is that, should additional support be required for, for example, constructing a larger skylight system, this support can be obtained by increasing the width of the support rafter. The width is defined by the letter W as shown in FIGS. 2 and 3. It is further to be understood that this width can vary considerably without requiring the redesign and refabrication of the sill. This is accomplished by always providing the groove 64, which is defined in the support rafter 60 to receive flange 32, at a given distance from the top surface 70 of the support rafter 60 and allowing the distance between the groove 66 and the bottom surface 72 of the support rafter to vary, depending on the required width.

The skylight system 10 further includes first and second sill caps 74 and 76 respectively. First and second sill caps 74 and 76 are substantially U-shaped in cross section and, in a preferred embodiment, are comprised of aluminum extrusions. First sill cap 74 includes first and second legs 78 and 80. A portion of the first leg 78 is inserted into the second channel 36, and a portion of the second leg 80 defines a flange 82.

Flange 82 is disposed at an angle from the rest of second leg 80. In a preferred embodiment, this flange 82 is disposed at approximately a 135° obtuse angle from second leg 80. Projected from this flange is an auxiliary flange 83, which is substantially perpendicular to the flange 80 and which projects into the center of the U-shaped sill cap 74.

First leg 78 includes a substantially V-shaped tip 84 and an adjacent ridge 86. V-shaped tip 84 can be urged into second channel 36. To do this the ridge 86 is urged over the bulbous end 46, and the V-shaped end is compressed slightly, and in cooperation with bulbous end 46 and ridge 86 keeps the first sill cap 74 rigidly in place.

Again, no bolts or other fastening mechanisms are needed to so position the first sill cap 74.

The second sill cap 76 is nested about the first sill cap 74. The second sill cap 76 is substantially identical to the first sill cap 74, except that second sill cap 76 is larger. Second sill cap 76 includes first and second legs which are identical to the first and second legs of the first sill cap 74. The first leg of the second sill cap 76 is received in the first channel 34 much as the first leg of the first sill cap is received in the second channel 36. The second leg 90 of the second sill cap 76 defines a flange 92 which is identical to the flange 82 which was previously defined by the first sill cap 74. Additionally, an auxiliary flange 94 projects from flange 92 in much the same manner that auxiliary flange 83 projects from flange 82.

As can be seen both in FIGS. 2 and 3, a first gasket 100 is disposed on top of support rafter 60. In a preferred embodiment, the first gasket 100 is comprised of a neoprene extrusion. The neoprene extrusion includes a base 102 which rests on top of the top surface 70 of the support rafter 60. First and second downwardly dependent sides 104 and 106 of first gasket 100 are deposed about the walls 68, 69 of support rafter 60. These sides 104, 106 form a channel 107 that keeps the first gasket 100 in place on top of the support rafter 60.

Located immediately above sides 104 and 106 are first and second upstanding supports 108 and 110. Each of these upstanding supports 108 and 110 include a plurality of grooves 112 and 114. These grooves provide an airtight seal with the panels which are disposed thereon. As can be seen in FIG. 2, panels 13 and 15 are placed on top of upstanding supports 108 and 110 respectively.

The first gasket 100 further includes an alignment channel 116 which is used to align the second gasket 118 therewith. Second gasket 118 (FIG. 2) is, in a preferred embodiment, a neoprene extrusion. Second gasket 118 is comprised of a base 120 which is disposed on top of panels 13 and 15. Second gasket 118 includes a protruding ridge 122 which is received in alignment channel 116 of the first gasket 100 in order to align the first and second gaskets. Second gasket 118 includes first and second upstanding supports 124 and 126 which are substantially similar to upstanding supports 108 and 110 except that they are provided at a desired height to provide the appropriate spacing between the panels 12 and 13, and 14 and 15 to trap the appropriate amount of air between said panels to provide for the desired thermally insulating properties. Upstanding from base 120 of second gasket 118 is another alignment channel 128.

A cap gasket 130 is disposed above and rests on panels 12 and 14. Cap gasket 130 includes a base 132 which has a downwardly dependent protruding ridge 134 which mates with the alignment channel 128 of the second gasket 118. The first and second ends 136 and 138 of the cap gasket 130 are rolled over to define U-shaped channels which are used to receive and hold a strap 140 which can be comprised of aluminum and other suitable materials and which is used to hold the entire skylight structure together as will be described hereinbelow. It is to be understood that the other support rafters have a similar gasket and panel arrangement as described previously hereinabove with the exception of the support rafter which is located at either end of the skylight system 10, as described below.

As can be seen in FIG. 3, the panels 14 and 15 are received under and held in place by the flange 82 of the first sill cap 74. These panels rest on the gasket 54 (FIG. 3). The other panels 12 and 14 are held under the flange 92 of the second sill cap 76. Further, as can be seen in FIG. 3, the strap 140 ends in a means 141 for cooperating with the flange 94 of the second sill cap 76 to selectively tighten the strap 140. In order that the cooperating means can be received by the auxiliary flange 94, a portion of the first flange 92 is removed or notched out as shown in FIG. 3 at 101. The width of this removed portion is slightly greater than the width of the strap 140.

The cooperating means 141 includes a plurality of spaced apart flanges 144 which are substantially parallel and which are sloped backwardly toward the remainder of strap 140 so that they are substantially parallel to the auxiliary flange 94. It is to be understood that the flanges 144 can be urged through the removed portion of the flange 92 until they come in engagement with the auxiliary flange 94. It also to be appreciated that in order to tighten strap 140 to hold all the panels in place, successive flanges of the spaced apart flanges 144 can be selectively engaged with the auxiliary flange 94 until the appropriate tension is placed on the strap 140.

The skylight system 10 includes an end sill 150 which is secured to the structure 20 with appropriate means as, for example, by a bolt 152. End sill 150 includes first and second upwardly directed channels 154 and 156 which overhang the end of structure 20. These upwardly directed channels receive the end panels 18 and 19 as shown in FIG. 2. These upwardly directed channels have weepholes 158 and 160 which allow moisture to escape.

The upper end of the end panels 18 and 19 are held in a position by an end panel gasket 162. End panel gasket 162 is comprised of, in a preferred embodiment, a neoprene extrusion. End panel gasket 162 includes first and second downwardly dependent and disposed channels 164 and 166. These channels receive end panels 18 and 19 respectively. These channels includes bulbous ends such as ends 168, 170 and 172 which are urge against the ends of end panels 18 and 19 and hold end panels securely in place. End panel gasket 162 further includes an arm 174 which is disposed at approximately a 90° angle to the direction of the channels 166 and 164. This arm 174 includes a lip 176 which is downwardly dependent from the arm 174. The arm 174, as can be shown in FIG. 2, is disposed over an upstanding member of a second gasket 180 which is similar in design and construction to the second gasket 118 previously described. In effect, the arm 174 takes the place of the thickness of the panel. It is also to be seen from FIG. 2 that a spacing panel 119 must be disposed between the first gasket 182 which is mounted on top of support rafter 62 and the second gasket 180 so as to compensate for the thickness of the panel 13.

It is to be understood that if it is desired to have only a single glazed skylight, skylight system 10 can be used for constructing such a single glazed skylight by simply not including a second set of panels 12 14 and 16, and by not including the second gaskets such as gaskets 118 and 180, and by not including the second still cap 76. With this situation, the strap, and particularly the cooperating means thereof, which includes a plurality of spaced apart flanges such as flanges 144, would be inserted through a removed portion in the second leg 80 of the first sill cap 74, much as it is presently shown disposed through a removed portion of a second sill cap 76.

Further, it is to be understood that triple glazing can be accomplished in much the same way by including a third sill cap which is nested about the second sill cap 76, and appropriate channels, such as channel 34, would be provided in the sill 22 to accommodate a leg of the third sill cap.

Industrial Applicability

The skylight system 10 of the present invention is assembled and operated in the following manner.

Initially the sill 22 and the end sills 150 are disposed about the support structure 20. Then the support rafters such as rafter 60, are popped into place so that the rafters are retained on the flanges such as flange 32. When the appropriate support rafters are in place, the first gaskets are placed on the support rafters, and the first set of panels, such as panels 13 and 15, are disposed on the first gaskets. The first sill cap, such as sill cap 74, is urged lockingly into place in the channel of the sill so as to hold the panels under the flanges of the sill cap. The second gaskets, such as gasket 118, are then positioned and aligned with the first gaskets, and the panels such as panels 12 and 14 are positioned on top of the second gaskets. At this point, the end panel gasket 162 and the end panels 18 and 19 are properly positioned. The second sill cap 76 is then urged into the appropriate channel in the sill 22, and the flange 92 is urged over the panels as shown in FIG. 3. The straps 140 are then positioned in alignment with the second gaskets with the cooperating means 141 and particularly the spaced-apart flanges 144 urged under the flange 92 into engagement with auxiliary flange 94 so as to tighten the strap above the panels and to hold the panels and the gaskets in place on top the support rafters. Thus, a waterproof, double glazed skylight system 10 is constructed.

From the above it can be seen that the present skylight system 10 provides the advantage of ease of construction over a wide variety of sizes of skylights without the necessity of stocking various size extrusions. There is also the advantage of ease of construction due to the fact that all the parts snap together without the necessity of providing bolts and approximately disposed threaded bores in the various extrusions. Additionally, most of the metal for the skylight system 10 is disposed underneath the panels so that it can support the weight of the panels while the strapping mechanism which holds the panels in place over the support rafters is of minimal weight, but yet accomplishes the required task.

Other advantages and objects of the invention can be learned from the review of the claims and the appended drawings.

I claim:

1. A skylight system comprising:

a sill adapted to be fastened to a structure; at least one support rafter;

means for interconnecting the support rafter and the sill;

a first sill cap which is substantially U-shaped;

first means for interconnecting the first sill cap with the sill, which interconnecting means includes a first channel extending from said sill and a portion of said first sill cap which is lockingly inserted into said first channel;

a second sill cap which is substantially U-shaped;

second means for interconnecting the second sill cap with the sill, with the second sill cap nested about the first sill cap, which second interconnecting means includes a second channel extending from said sill and a portion of said second sill cap which is lockingly inserted into said second channel;

a first gasket;

means for mounting said first gasket to said support rafter;

a first panel;

said first sill cap having a first sill flange means for positioning said first panel between said first sill cap flange means and said first gasket mounted on said support rafter;

a second gasket;

means for mounting said second gasket to said first panel in line with said first gasket;

a second panel;

said second sill cap having a second sill cap flange means for positioning said second panel between said second sill cap flange means and said second gasket mounted on said first panel;

strap means for holding said first and second panels in place, said strap means positioned over said second panel, said strap means including means for cooperating with said second sill cap flange means to selectively tighten said strap means.

2. The skylight system of claim 1 wherein said means for interconnecting the support rafter and the sill includes:

a rafter flange extending from said sill, wherein said flange defines groove means for receiving said support rafter.

3. The skylight system of claim 1 wherein said means for interconnecting the support rafter and the sill includes;

a rafter flange extending from one of said sill and said support rafter; and the other of said sill and support rafter defining a groove for receiving said flange.

4. The skylight system of claim 1 wherein said means interconnecting said support rafter and said sill includes a rafter flange and wherein said rafter flange extends from said sill in a direction which is opposite to the direction of extension of said first and second channels from said sill.

5. The skylight system of claim 1 wherein each of said sill caps have first and second legs, said portions of said first and second sill caps which are inserted in said first and second channels respectively comprise portions of said first legs respectively, and said sill cap flange means of said first and second sill caps comprise portions of said second legs respectively.

6. The skylight system of claim 1 including a cap gasket, said cap gasket positioned between said strap means and said second panel, said cap gasket and said first and second gaskets each having alignment means for aligning said cap, first and second gaskets with each other and with the support rafter.

7. The skylight system of claim 1 including:

third and fourth panels;

said third panel spaced from said first panel and supported by said first gasket;

said fourth panel spaced from said second panel and supported by said second gasket;

a cap gasket;

said cap gasket positioned between said strap means and said second and fourth panels, said cap gasket and said second gasket each having alignment means for aligning said gaskets with each other, said alignment means located at least partially in the space between said spaced apart first and third panels;

said second and first gaskets each having alignment means for aligning said gaskets with each other, said alignment means located at least partially in the space between said spaced apart second and fourth panels.

8. The skylight system of claim 1 wherein at least one of said first and second gaskets includes drainage channels.

9. The skylight system of claim 1 wherein at least said second gasket includes a drainage channel along the length thereof.

10. The skylight system of claim 1 wherein said means for interconnecting the support rafter and the sill includes:

a rafter flange extending from said sill in a direction opposite to said first channel of said sill, said support rafter defining a groove, said rafter flange of said sill received in said groove.

11. The skylight system of claim 10 wherein said rafter flange extending from said sill has at least one groove which is received in said groove of said support rafter so as to lockingly position said support rafter with respect to said sill.

12. The skylight system of claim 1 wherein said cooperating means of said strap means includes a plurality of spaced-apart flanges which can be successively urged into engagement with said second sill cap flange means to selectively tighten said strap means.

13. The skylight system of claim 12 wherein said second sill cap flange means includes a removed portion for receiving said strap means, and said second sill cap flange means includes another flange means extending therefrom for engaging selectively with one of each plurality of said spaced-apart flanges of said cooperating means.

14. A skylight comprising:

a sill adapted to be fastened to a structure;

at least one support rafter;

means for interconnecting the support rafter and the sill;

a sill cap which is substantially U-shaped with first and second legs;

means for interconnecting the sill cap with the sill which interconnecting means includes a channel extending from said sill and said first leg of said sill cap which is lockingly inserted into said channel;

a gasket;

means for mounting said gasket to said support rafter;

a panel;

said sill cap having a sill cap flange means for allowing said panel to be positioned between said sill cap flange means and said gasket mounted on support rafter;

strap means for holding said panel in place, said strap means positioned over said panel, said straps means including means for cooperating with said sill cap flange means to selectively tighten said strap means.

15. The skylight system of claim 14 wherein said means for interconnecting the support rafter and the sill includes:

a rafter flange extending from said sill, wherein said rafter flange defines groove means for receiving said support rafter.

16. The skylight system of claim 14 wherein said means for interconnecting said support rafter and said sill includes a rafter flange and wherein said rafter flange extends from said sill in a direction which is opposite to the direction of extension of said channel from said sill.

17. The skylight system of claim 14 including a cap gasket, said cap gasket positioned between said strap means and said panel, said cap gasket and said gasket each having alignment means for aligning both said gaskets with each other and with said support rafter.

18. The skylight system of claim 14 including an end gasket, said end gasket having a first portion disposed between said gasket and said strap means, said end gasket having a second portion defining a channel, and an end panel received in said channel.

19. The skylight system of claim 14 wherein said gasket includes a drainage channel along the length thereof.

20. The skylight system of claim 14 wherein said means for interconnecting the support rafter and the sill includes:

a rafter flange extending from said sill, said support rafter defining a groove, said rafter flange received in said groove.

21. The skylight system of claim 20 wherein said rafter flange extending from said sill has at least one groove which is received in said groove of said support rafter so as to lockingly position said support rafter with respect to said sill.

22. The skylight system of claim 14 wherein said cooperating means of said strap means includes a plurality of spaced-apart flanges which can be successively urged into engagement with said sill cap flange means to selectively tighten said strap means.

23. The skylight system of claim 22 whrein said sill cap flange means includes a removed portion for receiving said strap means, and said sill cap flange means includes another flange means extending therefrom for engaging selectively with one of said plurality of said spaced apart flanges.

24. The skylight system of claim 14 wherein said gasket mounting means includes a first channel defined by side walls which receives a portion of said support rafter, said gasket further including an alignment channel and first and second upstanding supports, at least one of said upstanding supports supporting said panel.

25. The skylight system of claim 24 including a cap gasket, said cap gasket positioned between said strap means and said panel, said cap means including a ridge which is received in the alignment channel.

26. A device for supporting panels including:

a sill adapted to be fastened to a structure;

at least one support rafter;

means for interconnecting the support rafter and the sill;

a first sill cap which is substantially U-shaped and;

first means for interconnecting the first sill cap with the sill which first interconnecting means includes a first channel extending from said sill and a portion of said first sill cap which is lockingly inserted into said first channel;

a second sill cap which is substantially U-shaped;

means for interconnecting the second sill cap with the sill, with the second sill cap nested about the first sill cap which second interconnecting means includes a second channel extending from said sill and a portion of said second sill cap which is lockingly inserted into said second channel;

a first gasket;

means for mounting said first gasket to said support rafter;

a first panel;

said first sill cap having a first sill flange means for positioning said first panel between said first sill cap flange means and said first gasket mounted on said support rafter;

a second gasket;

means for mounting said second gasket to said first panel in line with said first gasket;

a second panel;

said second sill cap having a second sill cap flange means for positioning said second panel between said second sill cap flange means and said second gasket mounted on said first panel;

strap means for holding said first and second panels in place, said strap means positioned over said second panel, said strap means including means for cooperating with said second sill cap flange means to selectively tighten said strap means.

27. The skylight system of claim 26 wherein at least one of said first and second gaskets includes drainage channels.

28. A device for supporting at least one panel including:

a sill adapted to be fastened to a structure;

at least one support rafter;

means for interconnecting the support rafter and the sill;

a sill cap which is substantially U-shaped;

means for interconnecting the sill cap with the sill which interconnecting means includes a channel extending from said sill and a portion of said sill cap which is lockingly inserted into said first channel;

a gasket;

means for mounting said gasket to said support rafter;

a panel;

said sill cap having a sill cap flange means for allowing said panel to be positioned between said sill cap flange means and said gasket mounted on support rafter;

strap means for holding said panel in place, said strap means positioned over said panel, said strap means including means for cooperating with said sill cap flange means to selectively tighten said strap means.

29. The skylight system of claim 28 wherein said gasket includes a drainage channel along the length thereof.

30. A skylight system comprising:

a sill adapted to be fastened to a structure;

at least one support rafter;

means for interconnecting the support rafter and the a first sill cap which is substantially U-shaped;

first means for interconnecting the first sill cap with the sill, which interconnecting means includes a first channel extending from said sill and a portion of said first sill cap which is lockingly inserted into said first channel;

a second sill cap;

second means for interconnecting the second sill cap with the sill, with the second sill cap nested about the first sill cap which second interconnecting means includes a second channel extending from said sill and a portion of said second sill cap which is lockingly inserted into said second channel;

a first panel;

said first sill cap having a first sill flange means for positioning said first panel between said first sill cap flange means and said support rafter;

a second panel;

said second sill cap having a second sill cap flange means for positioning said second panel between said second sill cap flange means and said first sill cap;

strap means for holding said first and second panels in place, said strap means positioned over said second panel, said strap means including means for cooperating with said second sill cap flange means to selectively tighten said strap means.

31. A skylight comprising:

a sill adapted to be fastened to a structure;

at least one support rafter;

means for interconnecting the support rafter and the sill;

a sill cap which is substantially U-shaped;

means for interconnecting the sill cap with the sill which interconnecting means includes a channel extending from said sill and a leg of sill cap which is lockingly inserted into said channel;

a panel;

said sill cap having a sill cap flange means for allowing said panel to be positioned between said sill cap flange means and said support rafter;

strap means for holding said panel in place, said strap means positioned over said panel, said straps means including means for cooperating with said sill cap flange means to selectively tighten said strap means.

* * * * *

UNITED STATES PATENT AND TRADEMARK OFFICE

CERTIFICATE OF CORRECTION

PATENT NO. : 4,539,783

DATED : September 10, 1985

INVENTOR(S) : WILLIAM F. O'KEEFFE et al

It is certified that error appears in the above-identified patent and that said Letters Patent is hereby corrected as shown below:

Column 1, line 42, "which" should be --while--.

Column 1, line 49, "3,762,128" should be --3,762,120--.

Column 9, line 31, "each" should be --said--.

Column 12, line 2, after "the" (second occurrence) insert --sill;--.

Signed and Sealed this

*Seventh* Day of *January 1986*

[SEAL]

*Attest:*

DONALD J. QUIGG

*Attesting Officer*

*Commissioner of Patents and Trademarks*